US005572984A

United States Patent [19]

Alden et al.

[11] Patent Number: 5,572,984

[45] Date of Patent: Nov. 12, 1996

[54] MODULAR FOOD SERVICE KIOSK

[75] Inventors: Lorne B. Alden, Shelburne; James T. Cole, Essex Junction, both of Vt.; George McMahon, Manchester, N.H.

[73] Assignee: G.S. Blodgett Corporation, Burlington, Vt.

[21] Appl. No.: 377,564

[22] Filed: Jan. 24, 1995

[51] Int. Cl.[6] ..... F24C 15/20

[52] U.S. Cl. ..... 126/299 R; 126/299 F; 126/39 R; 126/299 D

[58] Field of Search ..... 126/299 R, 39 R, 126/299 D, 299 F; 186/44; 237/19; 312/7.1

[56] References Cited

U.S. PATENT DOCUMENTS 2,897,813 8/1959 Schindler et al. ..... 126/39 R 4,828,171 5/1989 Akin, Jr. et al. ..... 237/19

4,828,340 5/1989 Jorgensen ..... 312/7.1

5,163,536 11/1992 Tuhro et al. ..... 186/44

*Primary Examiner*—Larry Jones

*Attorney, Agent, or Firm*—Donald C. Casey

[57] ABSTRACT

A modular kiosk for use in the food service industry is described. The kiosk includes one or more structural units having upstanding sides and back, and a horizontal roof with couplings on the back thereof for coupling appliances disposed in the unit to sources of energy. The unit typically would have metal, upper and lower sections, each receiving a different appliance for cooking or storing food. The unit can include a hood disposed at eye level and a griddle or deep fat fryer disposed below the hood in the middle section. When a hood is included, the hood is intended to be coupled to a flue. The device is intended to be used in malls and open areas for cooking and dispensing food.

9 Claims, 2 Drawing Sheets

MODULAR FOOD SERVICE KIOSK

FIELD OF THE INVENTION

This invention relates to the food service industry and in particular to modular units which may be used to house separate appliances for cooking, storing and displaying food items, which units can be interconnected if necessary and are intended to be free standing with electrical, gas, and ventilation capabilities for said appliances.

DESCRIPTION OF THE PRIOR ART

Food service equipment used for the fast food industry often consists of free standing appliances purchased from a number of different suppliers or manufacturers which are not necessarily tailored to efficient utilization of space. In addition, prior art hoods are normally disposed at a height of 78 inches off the floor over griddles, deep fat fryers and the like. Therefore, there is no ability to utilize the space above the hoods.

In addition, in malls, shopping centers and the like, kiosk type food dispensing centers are of increasing importance. There is a need to provide food service equipment in which food can be prepared, stored and displayed with an efficient utilization of space so that kiosk units can provide prepared food for passers by.

Various attempts have been made in the prior art to provide modular type cooking equipment. For example, in U.S. Pat. No. 5,163,536 there is described a counter type system having two tiers wherein modules are interconnected in an end-to-end relationship to provide, for example, food preparation areas adjacent salad bars, steam tables and the like. This patent, however, does not describe an overhead system for utilization of overhead space and does not describe a full range of appliances normally found in fast food operations including provisions for servicing the same.

U.S. Pat. Nos. 2,897,813, 4,828,171 and 4,828,340 describe multipurpose chassis intended to provide base, midlevel and upper level storage space for holding different items. In U.S. Pat. Nos. 2,897,813 and 4,828,171 there are described chassis arrangements including slide out shelves, tracks and the like for gas fired appliances. In U.S. Pat. Nos. 4,828,340, the chassis structure is intended for stereo components, but provides for ventilation in the rear thereof.

There is a need, however, for all purpose modular components for housing the appliances normally needed in a food service operation, such as, griddles, deep fat fryers, steam or convection ovens, microwave ovens, refrigerators, and for providing for dry storage for raw materials, paper products and the like.

SUMMARY OF THE INVENTION

It is now been discovered that modular chassis can be provided which can house multiple appliances and provide ventilation and the utilities for them. Principally, at least one of such appliances would be a cooker such as a griddle, grill or deep fat fryer which would require a hood ventilation system. In order to more efficiently utilize space, the cooking device is provided at countertop level and the hood thereover is provided at eye level rather than at the conventional 78 inches above the floor. An overhead space is then provided which could house one or more of a convection or steam oven, microwave oven, and dry storage space. Below the countertop appliance, separate facilities can be provided for, for example, cold storage. It is intended that each module include the utility hook-ups necessary to service the appliances therein including gas, electric, and, if desired, water. The hood which is provided would have to be connected to a flue and it would be desirable to provide for grease-laden effluent, preferably by water washing the same. The utilities would be provided in the back of the unit with the front exposed. Modular units could be interconnected with the common feature that the appliances disposed therein could be removed for servicing off site.

Accordingly, it is an object of this invention to provide modular kiosk units for the food service industry.

It is another object to provide a chassis having an upper portion, a middle portion, and a lower portion, said chassis intended to mount food service appliances in said areas including one or more of an oven, a griddle, a grill, deep fat fryer, cold storage and in addition, dry storage.

It is yet another object of this invention to provide modular kiosk chassis units for the food service industry which are fully serviced with utilities and ventilation so that appliances normally used in the food service industry may be mounted in said chassis; such service includes gas, electric, ventilation, and water.

These and other objects will become readily apparent with reference to the drawings and following description wherein:

DETAILED DESCRIPTION OF THE PREFERRED EMBODIMENTS

Figure 1:
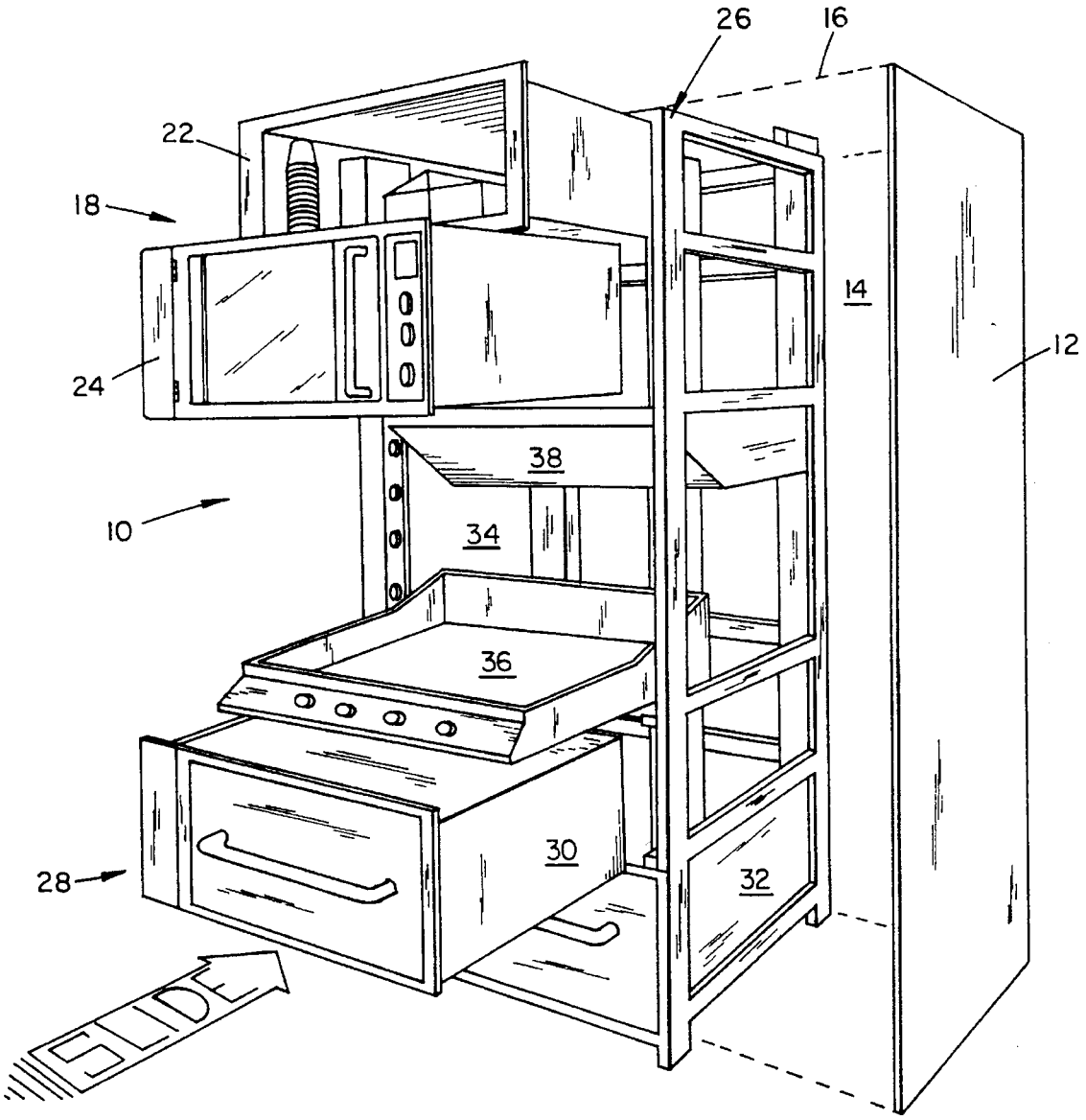
FIG. 1 is an exploded view of the modular kiosk chassis of this invention having individual appliance units partially removed.
Figure 2:
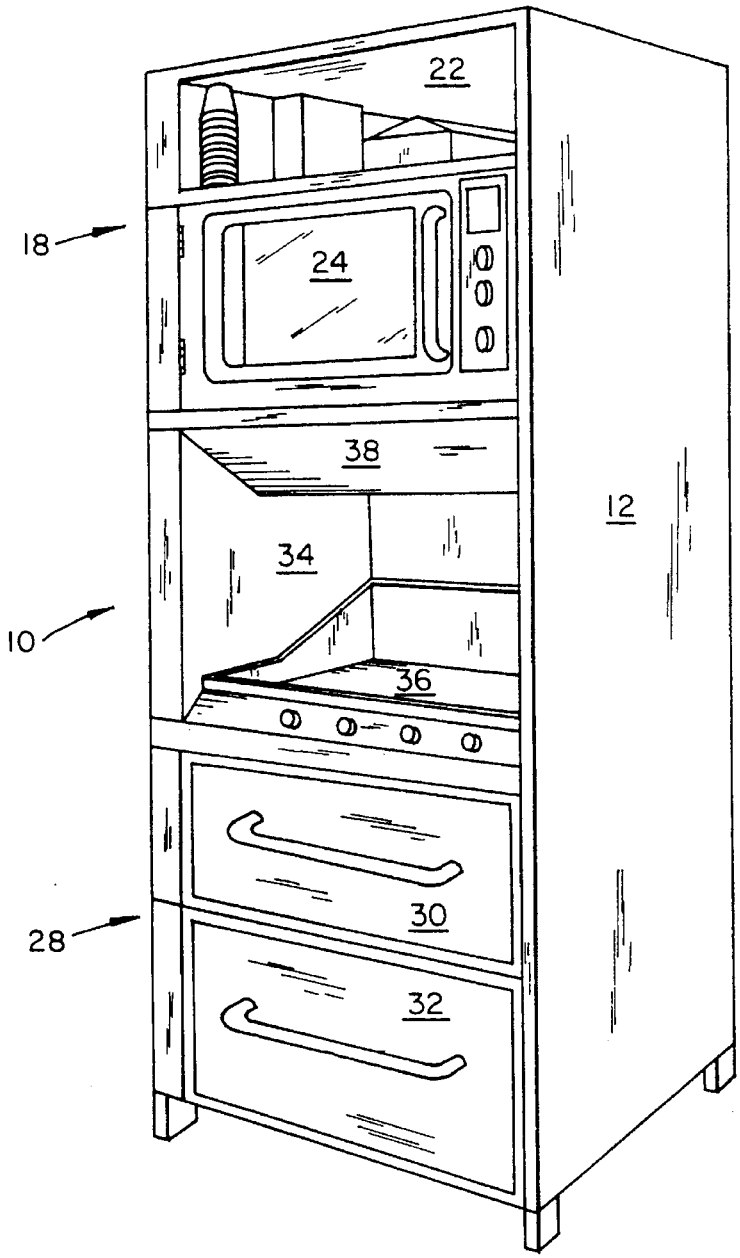
FIG. 2 is a perspective view of the modular kiosk unit of FIG. 1 fully assembled.

With attention to the drawings, FIGS. 1 and 2 show a preferred kiosk module 10 having vertical side walls 12 and a back wall 14. The side and back walls may further be interconnected by a top 16 to form a box to receive the stacked support members as will be described.

In the preferred embodiment of FIG. 1, the upper portion 18 of the chassis houses two components, a dry storage area 22, and an oven 24. Both members 22 and 24 are slidably received within the vertical chassis 26 on tracks (not shown) similar to a chest of drawers in construction. The tracks could have conventional locks so that the appliance would slide out but would have to be unlatched to be removed.

The lower portion 28 of chassis 26 mounts two drawers 30 and 32. These may be cold storage, or dry storage, or as will be obvious to those skilled in the art, one of drawers 30 may be replaced with, for example, a microwave oven whereas member 24 is preferably a steam or combination convection oven. In any event, members 30 as members 22 and 24, are intended to be slidably received within chassis 26 similar to a chest of drawers or a file cabinet. Chassis 26 further provides a central portion 34 which mounts a griddle 36 with a hood 38 thereabove. As will be obvious to those skilled in the art, the hood 38 is generally at the eye level of the chef working the griddle 36 whereby the area 18 above the hood 38 is available for other use. The griddle could be gas fired or electric, or as will be obvious to those skilled in the art, the griddle and member 30 could be replaced by a deep fat fryer unit (not shown), a charcoal or gas grill (not shown) or any other type of cooker requiring hood ventilation.

In the kiosk shown in FIGS. 1 and 2, a chef could have cold meat products stored in drawers 30 and 32, and could be cooking on a gas griddle 36 while simultaneously preparing food in oven 24. The food thus prepared would be available for a passersby to purchase and it is contemplated that the module of this invention would be disposed in an open area and, possibly, accompanied by a counter with a cash register and the like.

Figure 3:
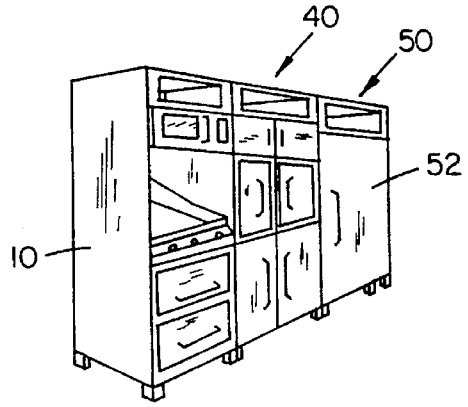
FIG. 3 is a perspective view of three of the kiosk units of this invention interconnected.

With attention to FIG. 3, the chassis 26, which is shown only in FIG. 1, could be adapted to provide a separate module 40, which could house lower, middle and upper storage compartments, and a modified chassis could provide a module 50 which would combine the center, lower and upper portions to provide, for example, a freezer compartment 52. It will be obvious to those skilled in the art, however, that the basic module of this invention can be substantially modified as desired to accommodate conventional types of appliances dimensioned to fit in the standard chassis spaces. Typically, such appliances would fit on internal rails and be slidably received in the chassis which in turn would be received within an outer box. The utilities for the appliances would normally be attached at the back. In this way, the hood system can be directly vented into a vent duct (not shown) and,if desired, grease laden effluent can be water washed in the conventional fashion. Also typically captured grease and water may be separated so that the water can be recycled.

The embodiments shown herein do not picture a drain or a water attachment. It is contemplated, however, that such would be available, if needed. Also not pictured is a conventional make-up table which could occupy the middle section in place of for example, a storage compartment.

The requirements for a vent duct or flue, gas and electrical attachments, and other similar requirements are external to the kiosk of this invention and would be provided in the conventional fashion.

In summary, a chassis for use in the food service industry is provided which has base, midlevel and upper level sections for housing conventional food service appliances for use in cooking food, storing food, displaying food or storing food or food related items. It is intended that the chassis will have connections for the delivery of gas and electricity to run the appliances, and a flue duct for connection to a vent or a hood type installation within the chassis. If desired, it is further intended that a drain and water connection be provided within the chassis.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A modular kiosk for food service preparation and storage comprising a first structural unit being rectangular in cross section and having upstanding side and rear walls and a horizontal roof and an open front;

horizontal upper, middle and lower sections formed in said unit each section adapted to slidably receive a service unit for preparing, cooking or storing food, said middle section including a ventilation hood mounted therein and cooking means disposed in said middle section below said hood for cooking food, the service unit in at least one of said lower or upper section including dry storage drawer means for storing supplies utility hook-up means mounted on the back wall of said unit for coupling appliances to a source of energy; and flue hook-up means carried by said unit for coupling said hood to an external flue.

2. The kiosk of claim 1 wherein said utility hookup means includes electrical hook-up means.

3. The kiosk of claim 1 wherein said utility hookup means includes natural gas hook-up means.

4. The kiosk of claim 1 further comprising a plurality of said units interconnected at the sides thereof.

5. The kiosk of claim 1 further comprising a second structural unit being rectangular in cross section and having upstanding side and rear walls and a horizontal roof and an open front interconnected to said first unit at a side thereof.

6. The kiosk of claim 5 wherein said second structural unit includes means for slidably receiving a cold storage unit therein.

7. The kiosk of claim 5 wherein said second unit includes upper, middle and lower sections and make-up table means mounted in said middle section.

8. The kiosk of claim 7 further comprising cold storage means mounted in one of said upper and lower sections.

9. A modular kiosk for food service preparation and storage comprising: a structural module being rectangular in cross section and having side and rear walls, a horizontal roof and an open front;

horizontal upper, middle and lower sections formed in said module each section adapted to slidably receive a service unit for preparing, storing or cooking for said service units including open food cooking means and hood therefor, oven means, cold storage means, dry storage means, and make-up table means; and utility hook-up means mounted in the back of said module for coupling a service unit to a source of energy, drain or flue.

* * * * *